US006201435B1

(12) United States Patent
Chou

(10) Patent No.: US 6,201,435 B1
(45) Date of Patent: Mar. 13, 2001

(54) LOW-POWER START-UP CIRCUIT FOR A REFERENCE VOLTAGE GENERATOR

(75) Inventor: Yung-Fa Chou, Kaohsiung (TW)

(73) Assignee: Taiwan Semiconductor Manufacturing Company, Hsin-Chu (TW)

( * ) Notice: Subject to any disclaimer, the term of this patent is extended or adjusted under 35 U.S.C. 154(b) by 0 days.

(21) Appl. No.: 09/383,600

(22) Filed: Aug. 26, 1999

(51) Int. Cl.[7] ..... G05F 1/10
(52) U.S. Cl. ..... 327/543; 327/538; 323/315
(58) Field of Search ..... 327/538, 540, 327/541, 543; 323/315, 313

(56) References Cited

U.S. PATENT DOCUMENTS

| | | | | |
|---|---|---|---|---|
| 5,155,384 | | 10/1992 | Ruetz | 327/537 |
| 5,243,231 | | 9/1993 | Baik | 327/546 |
| 5,565,811 | | 10/1996 | Park et al. | 327/546 |
| 5,825,237 | | 10/1998 | Ogawa | 327/545 |
| 5,847,593 | * | 12/1998 | Pernyeszi | 327/432 |
| 5,867,013 | | 2/1999 | Yu | 323/314 |
| 5,912,580 | * | 7/1999 | Kimura | 327/541 |
| 6,002,242 | * | 12/1999 | Migliavacca | 323/315 |
| 6,084,389 | * | 7/2000 | Gens et al. | 323/315 |

* cited by examiner

*Primary Examiner*—Terry D. Cunningham
(74) *Attorney, Agent, or Firm*—George O. Saile; Stephen B. Ackerman; Billy J. Knowles

(57) ABSTRACT

A reference voltage generation circuit has a start-up circuit that will force the reference voltage generation circuit to assume a normal operation mode producing the desired reference voltage level and will reduce noise coupled from a power supply voltage source. The start-up circuit for reference voltage generation circuit will be disabled when a sensing circuit has determined that the reference voltage generation circuit has attained the desired reference voltage level.

5 Claims, 6 Drawing Sheets

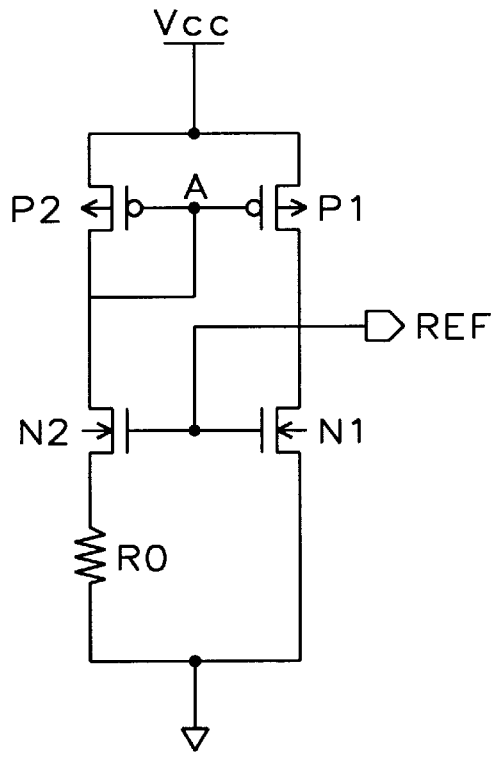
FIG. 1 – Prior Art
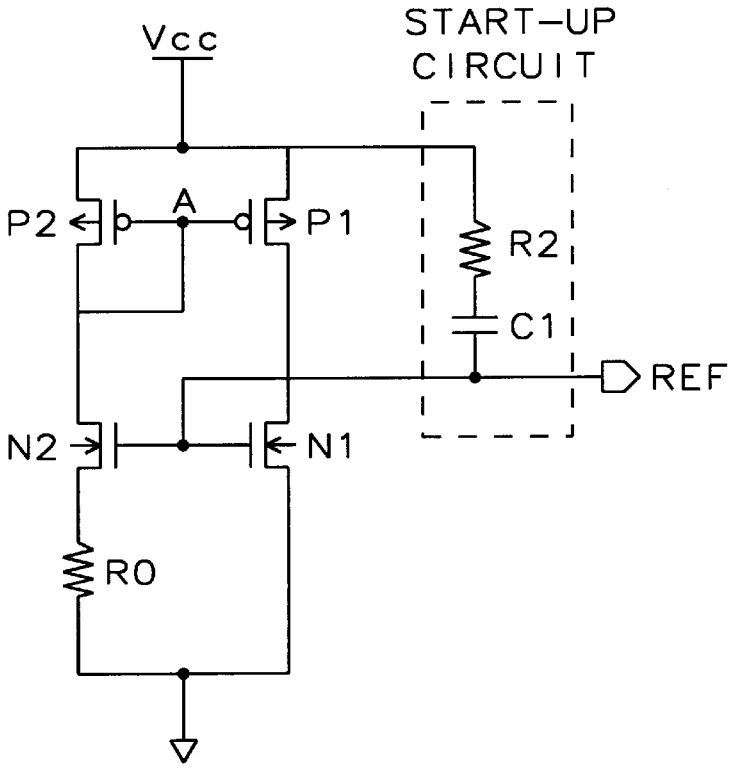
FIG. 2 – Prior Art

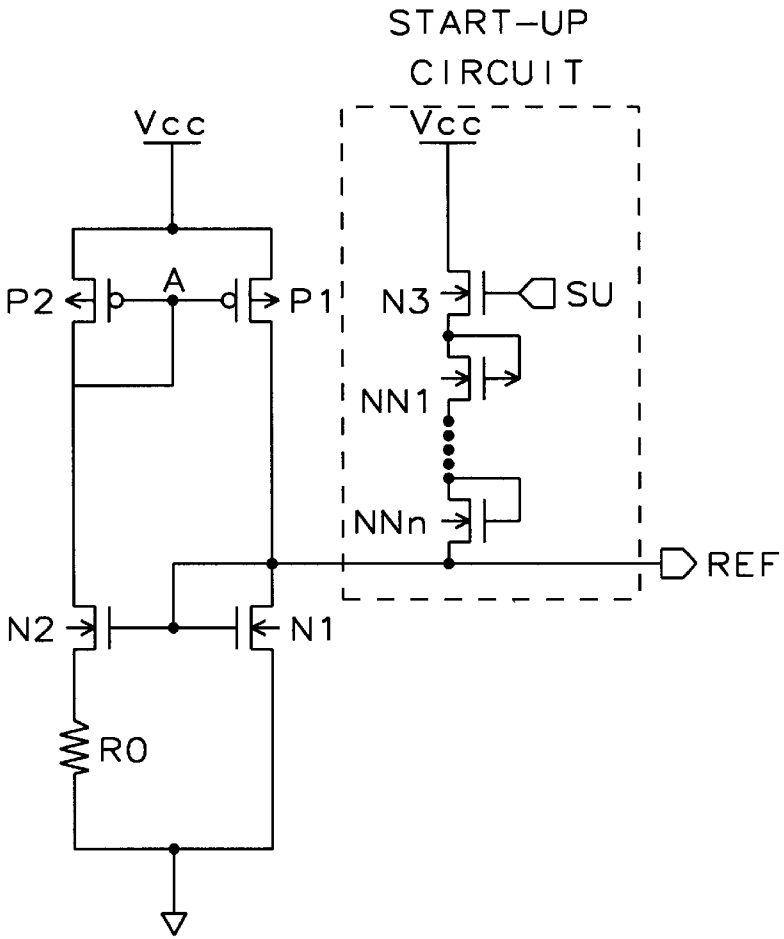
FIG. 4 – Prior Art
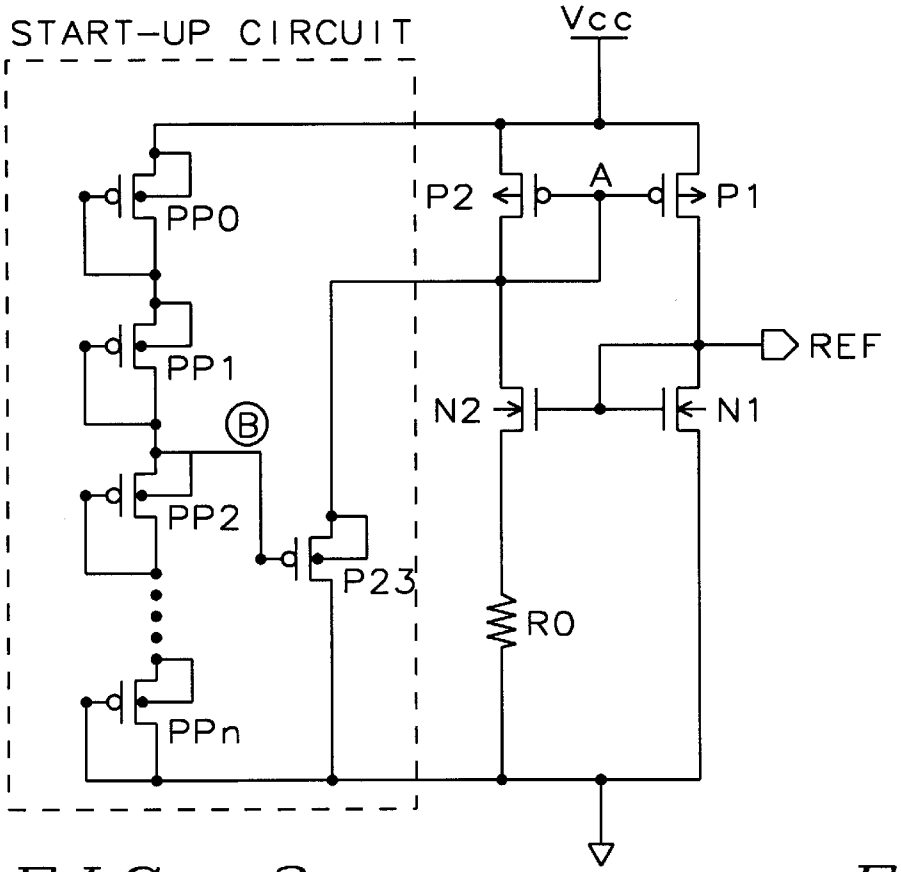
FIG. 3 – Prior Art

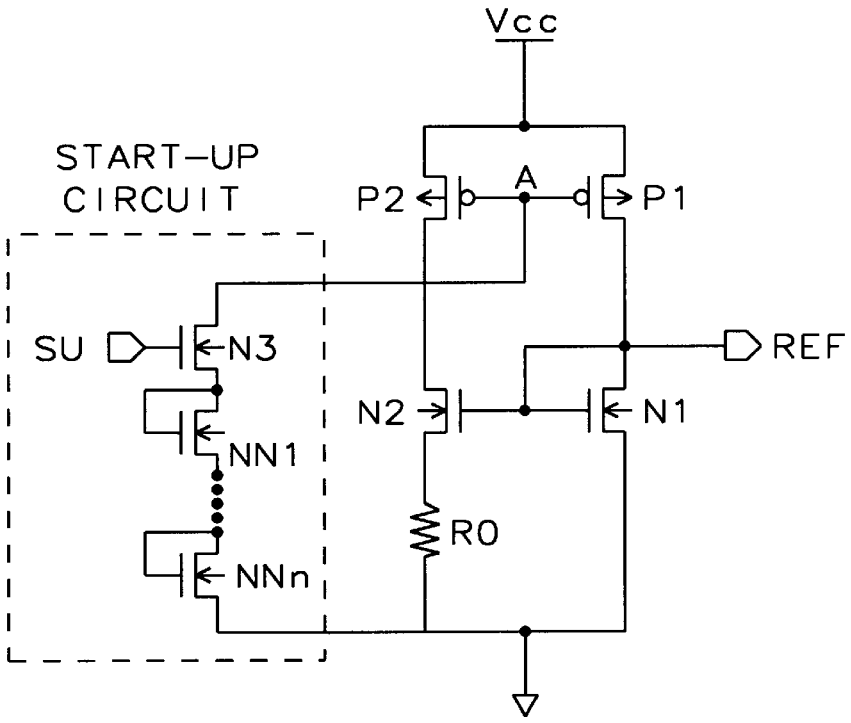
FIG. 5 – Prior Art
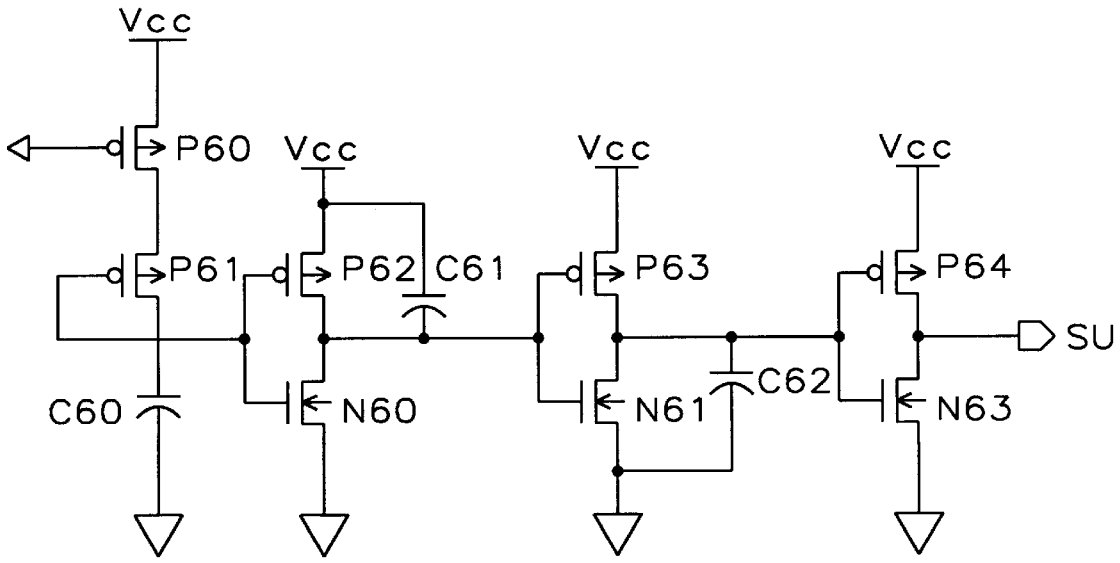
FIG. 6 – Prior Art

LOW-POWER START-UP CIRCUIT FOR A REFERENCE VOLTAGE GENERATOR

BACKGROUND OF THE INVENTION

1. Field of the Invention

This invention relates to electronic circuits that generate a constant reference voltage that is independent of a power supply voltage source. More particularly, this invention relates to start-up circuits connected to reference voltage generation circuits that will force the reference voltage generation circuits to the constant reference voltage at the initiation of the power supply voltage source.

2. Field of the Related Art

FIG. 1 illustrates a reference voltage generation circuit that is independent of the voltage level of the power supply voltage source. The reference voltage generation circuits have a pair of P-type Metal Oxide Semiconductor (MOS) Field Effect Transistors (FET) P1 and P2. The gates of the PMOS FET's P1 and P2 have their gates commonly connected together and to the drain of the second PMOS FET P2. The sources of the PMOS FET's P1 and P2 are connected to the positive terminal of the power supply voltage source. The reference voltage generation circuit, further, has two N-type MOS FET's N1 and N2. The NMOS FET's N1 and N2 have their gates commonly connected together and to the drains of the first PMOS FET P1 and the first NMOS FET N1 to form the reference output terminal REF. The reference output terminal contains the supply independent reference voltage. The source of the first NMOS FET N1 is connected to the ground reference terminal of the power supply voltage source. The drain of the second NMOS FET N2 is connected to the drain of the second PMOS FET P2 and the commonly connected gates of the PMOS FET's P1 and P2.

A resistor R0 is connected between the source of the second NMOS FET N2 and the ground reference terminal of the power supply voltage source.

The reference voltage generation circuit has two operational modes. In the normal operational mode, the reference voltage level at the output reference terminal REF is determined by the device parameters of the second PMOS FET P2 and the second NMOS FET N2 and the resistance value of the resister R0. The second mode occurs during initiation of the power supply voltage source. At this time all the MOS FET's have zero current flowing in them and zero voltage developing across them. This second mode prohibits the voltage level at the output reference terminal REF from achieving the reference voltage level without assistance.

U.S. Pat. No. 5,243,231 (Baik) provides a start-up circuit for the reference voltage generation circuit as shown in FIG. 2. The start-up circuit is composed of the resistor R2 and the capacitor C1. Current flows through the resistor R2 and the capacitor C1 during the initiation of the power supply voltage source. This places a voltage at the output reference terminal REF sufficient to turn on the first NMOS FET N1 to begin to sink current. The first PMOS FET P1 is then turned on as a result of the current in the first NMOS FET N1. As a result of the first PMOS FET P1 turn-on, the second PMOS FET P2 and the second NMOS FET N2 turn-on, the reference voltage generation circuit assumes the first operational mode having the reference voltage level present at the output reference terminal REF.

A problem with the start-up circuit of Baik is that any variations or noise present on the power supply voltage source is coupled through the resistor R2 and capacitor C1 to the output reference terminal REF. This causes undesired variations in the reference voltage level.

FIG. 3 shows a start-up circuit of the prior art as shown in U.S. Pat. No. 5,565,811 (Park et al.). The start-up circuit has a serial string of multiple diode connected PMOS FETs, PP0, PP1, PP2, . . . , PPn. The serial string of diode connected PMOS FET PPO, PPI, PP2, . . . , PPn each have their drains connected to the gate and to the source of the subsequent diode connected PMOS FET. The source of the first diode connected PMOS FET PPO is connected to the positive terminal of the power supply voltage source. The commonly connected drain and gate of the last diode connected PMOS FET PPn is connected to the ground reference terminal of the power supply voltage source.

A third PMOS FET P23 has its source connected to the commonly connected gates of the first and second PMOS FET's P1 and P2, its drain connected to the ground reference terminal of the power supply voltage source, and its gate connected to the junction B of the second and third of the serial diode connected PMOS FET's PP1 and PP2.

At the initiation of the power supply voltage source, the voltage level present at the junction B is the voltage level of the power supply voltage source less twice the threshold voltage level ($V_{cc}-2V_{TH}$). This voltage is sufficient to cause the third PMOS FET P23 to begin to conduct causing the second PMOS FET P2 to turn on and consequently causing the first PMOS FET P1 and the first and second NMOS FET's N1 and N2 to turn on establishing the reference voltage level at the output reference terminal REF. The start-up circuit of FIG. 3 has a current flowing constantly when the power supply voltage source it turned on. This is a waste of power and requires a static current to be provided by the power supply voltage source.

To eliminate the static current of the start-up current of FIG. 3 Park et al. describe a start-up circuit as shown in FIGS. 4 and 5. In this case the start-up circuit is composed of a serial string of diode connected NMOS FET's NN1, NN2, . . . , NNn. The diode connected NMOS FET have the gate connected to the drain of each NMOS FET as described above. A third NMOS FET N3 has its gate connected to a start-up terminal that will provide a start-up enable signal during the initiation of the power supply voltage source. The drain of the third MOS FET N3 is connected to the commonly connected gates of the first and second PMOS FET's P1 and P2 as shown in FIG. 5 or to the positive terminal of the power supply voltage source of FIG. 4. The source of the third NMOS FET N3 is connected to the commonly connected gate and drain of the first diode connected NMOS FET NN1.

The source of the last diode connected NMOS FET NNn is connected to the ground reference terminal of the power supply voltage source as shown in FIG. 5 or the output reference terminal REF in FIG. 4.

In FIG. 4, the start-up enable signal turns on the third NMOS FET N3. The current through the serial string of diode connected NMOS FET's NN1, NN2, . . . , NNn increases the voltage level at the output reference terminal sufficient to turn on the first NMOS FET N1. As described above, the current in the first NMOS FET N1 causes the second NMOS FET N2 and the first and second PMOS FET's P1 and P2 to activate to establish the reference voltage level at the output reference terminal.

In the start-up circuit of FIG. 5, the start-up enable signal turns on the third NMOS FET N3 causing current to flow in the serial string of diode connected NMOS FET's NN1, NN2, . . . , NNn. This causes the second PMOS FET P2 to turn on and consequently the first PMOS FET P1 and the first and second NMOS FET's N1 and N2. This establishes the reference voltage level at the output reference terminal REF as described above.

In both examples, the start-up enable signal will assume a disable state when the voltage level of the power supply voltage source attains its final level. The third NMOS FET N3 becomes turned off and no current is flowing in the start-up circuit.

FIG. 6 illustrates an example of the start-up circuit of Park et al. The PMOS FET P62 and the NMOS FET N60, the PMOS FET P63 and NMOS FET N61, the PMOS FET P64 and the NMOS FET N63 are each configured as a CMOS inverter. The PMOS FET P60 has its source connected to the positive terminal of the power supply voltage source, its gate connected to the ground reference terminal of the power supply voltage source and its drain connected to the diode connected PMOS FET P61. The gate and drain of the diode connected PMOS FET P61 is connected to the commonly connected gates of the PMOS FET P62 and the NMOS FET N60. The capacitor C60 is connected between the gate and drain of the diode connected PMOS FET P61 and the ground reference terminal of the power supply voltage source.

The drains of the PMOS FET P62 and the NMOS FET N60 are connected to the commonly connected gates of the PMOS FET P63 and the NMOS FET N61. The capacitor C61 is connected between the commonly connected gates of the PMOS FET P63 and NMOS FET N61 and the positive terminal of the power supply voltage source.

The drains of the PMOS FET P63 and NMOS FET N61 are connected to the commonly connected gates of the PMOS FET P64 and the NMOS FET N63. The capacitor C62 is connected between the commonly connected gates of the PMOS FET P64 and the NMOS FET N63 and the ground reference terminal of the power supply voltage source. The drains of the PMOS FET P64 and the NMOS FET N63 are connected to the start-up enable terminal SU to transfer the start-up enable signal to the start-up circuits of FIG. 4 and 5.

It can be seen that upon initialization of the power supply voltage source, i15 the start-up enable signal is close to the voltage level of the power supply voltage source thus turning on the third NMOS FET transistor N3 of the FIG. 4 and 5. When the capacitors C60, C61 and C62 has been charged to their correct values, the voltage level at the start-up enable terminal SU is sufficient to turn off the third NMOS FET transistor N3 of FIG. 4 and FIG. 5 thus disabling the start-up circuits. The start-up circuit of FIG. 4 and 5 and the start-up enable circuit of FIG. 6 require additional circuitry and add complexity to the reference voltage generation circuits of the prior art.

U.S. Pat. No. 5,825,237 (Ogawa) describes a reference voltage generation circuit similar to that of Park et al. The reference voltage generation circuit has a reference voltage circuit and a power source start circuit for starting the reference voltage circuit at the time of closure of the power source. This is to prevent fluctuations in the reference voltage during sharp fluctuations in the voltage level of the power source.

U.S. Pat. No. 5,155,384 (Ruetz) describes a start-up circuit for a bias or reference voltage generating circuit. The start-up circuit of Ruetz provides current source for providing a small charging current and transistors for coupling the charging current to the bias generating circuit during initiation of a power supply voltage source to force the bias generating circuit to the normal operational state. The start-up circuit uncouples the current source from the bias generating circuit after it has the normal operational state to prevent the charging current from affecting the operation of the bias generating circuit.

U.S. Pat. No. 5,867,013 (Yu) illustrates a start-up circuit for a band-gap reference voltage circuit. When the output of the band-gap reference circuit is below a start-up voltage threshold the start-up circuit provides a voltage at the input of the band-gap reference circuit sufficient to cause the band-gap reference circuit to produce the desired output voltage.

Once the output of the band-gap has reached the start-up threshold voltage the start-up circuit is disabled and does not interfere with the normal operation of the band-gap reference circuit.

SUMMARY OF THE INVENTION

An object of this invention is to provide a reference voltage generation circuit having a start-up circuit that will force the reference voltage generation circuit to assume a normal operation mode producing the desired reference voltage level.

Another object of this invention is to provide a start-up circuit for a reference voltage generation circuit that will reduce noise coupled from a power supply voltage source.

Further, another object of this invention is to provide a start-up circuit for reference voltage generation circuit that is disabled when the reference voltage generation circuit has attained the desired reference voltage level.

To accomplish these and other objects a reference voltage generation circuit has a reference voltage generator. The reference voltage generator is connected to a power supply voltage source for producing a reference voltage at an output reference terminal. The reference voltage level is independent of the power supply voltage source.

The reference voltage generation circuits, further, has a start-up circuit. The start-up circuit is connected to a voltage sense point within the reference voltage generator and the output reference terminal. The start-up circuit provides an initiation voltage to the reference voltage generator to force the output reference terminal to assume the reference voltage at the application of the power supply voltage source. The start-up circuit will reduce noise variations being coupled from the power supply voltage source to said reference voltage generator.

To assist the start-up circuit, the reference voltage generation circuit has a sensing circuit connected between the start-up circuit and the reference voltage generator. The sensing circuit disables the start-up circuit when the reference voltage is present and stabile at the output reference terminal.

The reference voltage generator is has a first and second MOS transistor of a first conductivity type. The first and second MOS transistors of the first conductivity type each have gates commonly connected to a drain of the first MOS transistor and sources connected the voltage terminal of the power supply voltage source. The reference voltage generator has a first and second MOS transistor of the second type. The first and second MOS transistors of the second conductivity type each have gates commonly connected to the drains of both the second MOS transistors of the first and second conductivity type. This forms an output bias reference terminal containing a bias reference voltage. The drain of the first MOS transistor is connected to the commonly connected gates of the first and second MOS transistor of the first conductivity type, and a source of the second MOS transistor of the second conductivity type is connected to the ground reference terminal of the power supply voltage source. A resistor is connected between the ground reference terminal of the power supply voltage source and the source of the first MOS transistor of the second conductivity type.

The start-up circuit is composed of a plurality of serial diode connected MOS FET's of a first conductivity connected between the sensing circuit and the output reference terminal to provide the initiation voltage. The start-up circuit is further composed of a diode connected MOS FET of a second conductivity type connected between the sensing circuit and the power supply voltage source to reduce noise variations.

The sensing circuit is formed of a sensing MOS FET of the first conductivity type. The sensing MOS FET has a source connected to the plurality of serial diode connected MOS FET's, a drain connected to the diode connected MOS FET of the second conductivity type, and a gate connected to the reference voltage generator. The sensing MOS FET turns off when the voltage present at the output reference terminal is the level of the reference voltage, thus disabling the startup circuit.

BRIEF DESCRIPTION OF THE DRAWINGS

FIG. 1 is a schematic diagram of a reference voltage generation circuit of the prior art.

FIGS. 2–5 are schematic diagrams of a reference voltage generation circuit with the start-up circuits of the prior art.

FIG. 6 is a schematic diagram of a sensing circuit for a start-up circuit of the prior art.

DETAILED DESCRIPTION OF THE INVENTION

Figure 7:
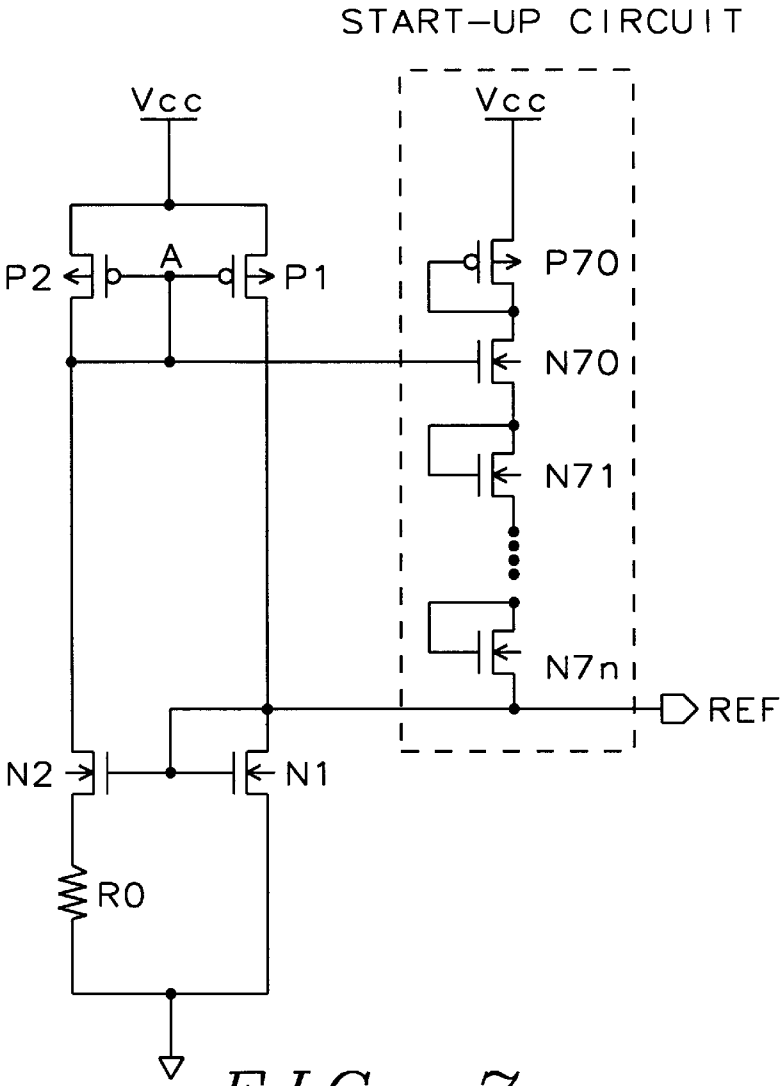
FIG. 7 is a schematic diagram of a first embodiment of a reference voltage generation circuit having a start-up circuit of this invention.

Refer now to FIG. 7 for a discussion of the structure and operation of the first embodiment of the reference voltage generation circuit of this invention. The PMOS FET's P1 and P2, the NMOS FET's N1 and N2, and the resistor R0 form the reference voltage generation circuit as shown in FIG. 1. The start-up circuit of the first embodiment of this invention is composed of the serial string of diode connected NMOS FET's N71, N72,. . . , N7n. The source of the diode connected NMOS FET N7n is connected to output reference terminal REF. The commonly connected gate and drain of the diode connected NMOS FET N71 is connected to the source of the NMOS FET N70. The drain of the NMOS FET N70 is connected to the commonly connected gate and drain of the PMOS FET P70. The source of the PMOS FET P70 is connected to the positive terminal of the power supply voltage source. The gate of the NMOS FET N70 is connected to the commonly connected gates of the PMOS FET's P1 and P2 (A).

When the power supply voltage source is in a power-down mode all transistors of the circuit have no current flowing in them. When the power supply voltage source is initiated it will begin to rise from zero volts. Likewise, the voltage level of the commonly connected gates of the first and second PMOS FET's P1 and P2 (A) begins to follow the voltage level of the power supply voltage source. At this time the voltage level of the output reference terminal REF remains at zero volts. When the voltage difference between the junction A of the commonly connected gates and the voltage level of the output reference terminal REF exceed the voltage level of the sum of the threshold voltage $V_{TH}$ of the serial string of diode connected NMOS FET's N71, . . . , N7n and the NMOS FET N70, the NMOS FET N70 turns on and the voltage level at the output reference terminal begins to rise. When the voltage level at the output reference terminal REF reaches the threshold voltage $V_{TH}$ of the first NMOS FET N1, the first NMOS FET N1 begins to conduct and the second NMOS FET N2 and the first and second PMOS FET's P1 and P2 conduct to force the reference voltage generation circuit to the normal operational state as described above.

In the normal operational state, the difference of the voltage level at the junction A of the commonly connected gates of the first and second PMOS FErs P1 and P2 and the voltage level of the output reference terminal REF decreases to less than the sum of the threshold voltages of NMOS FET N70 and the serial string of diode connected NMOS FET's N71, . . . , N7n, the NMOS FET N70 turns off to deactivate the start-up circuit.

The diode connected PMOS FET P70 acts to reduce the effects of noise present on the positive terminal of the power supply voltage source during initialization.

In normal operation, the difference of the voltage level at the junction A of the commonly connected gates of the first and second PMOS FET's P1 and P2 and the voltage level of the output reference terminal REF is known and the numbers of diode connected NMOS FET's can be appropriately determined.

Figure 9:
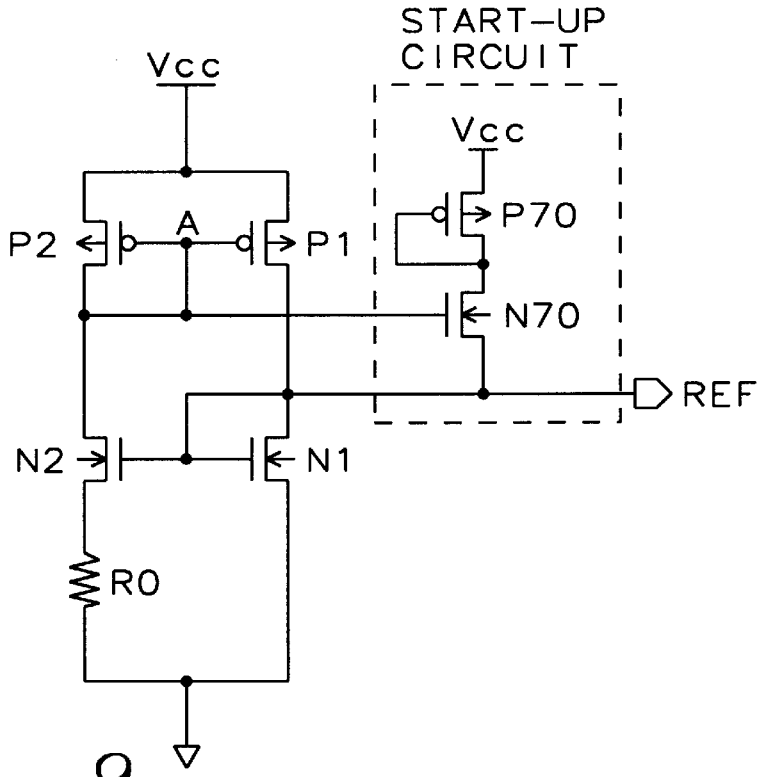
FIG. 9 is a schematic diagram of a simplified implementation of the first embodiment of the reference voltage generation circuit of this invention.

If the difference in the voltage level at the junction A of the of the commonly connected gates of the first and second PMOS FET's and the voltage level of the output reference terminal REF is less than one threshold voltage $V_{TH}$, the start-up circuit can be simplified as shown in FIG. 9. In FIG. 9 the serial string of diode connected NMOS FET's N71, . . . , N7n are eliminated and the start-up circuit is comprised of the NMOS FET N70 and the diode connected PMOS FET P70.

Figure 11:
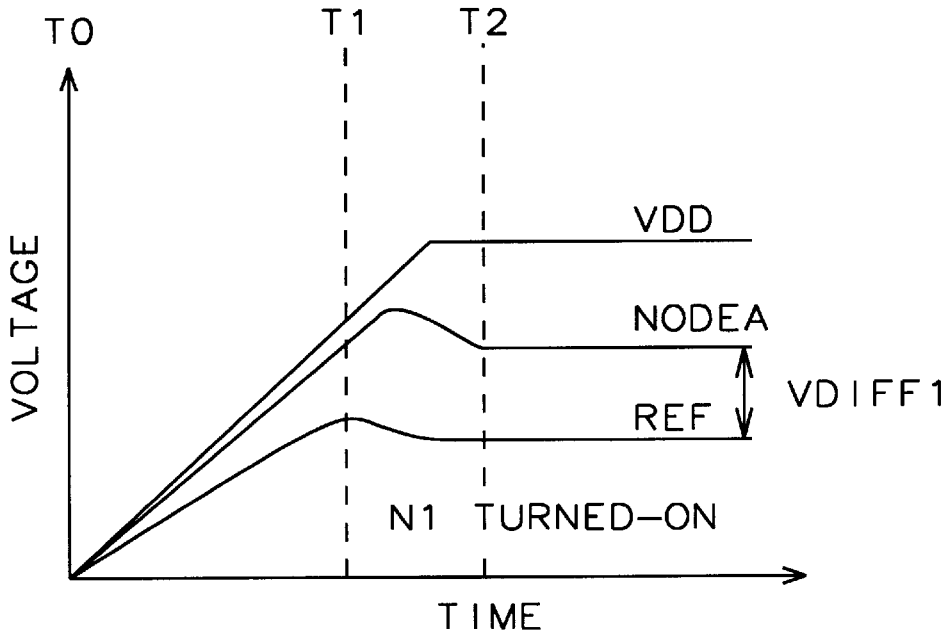
FIGS. 11 and 12 are plots of the voltage versus time of the voltages within the reference voltage generation circuit.

FIG. 11 shows a plot of voltage versus time of the reference voltage generation circuit of FIG. 7. At time $T_0$ the power supply voltage source is turned on and begins to rise towards its final value. As described above, the voltage level at the junction A of the commonly connected gates of the first and second PMOS FET's P1 and P2 follow the rise of the voltage level of the power supply voltage source. At the time $T_1$, the voltage level at the junction A of the commonly connected gates of the first and second PMOS FET's P1 and P2 exceeds the voltage level sufficient to turn on the NMOS FET N70 causing the first NMOS FET N1 to turn on. The second NMOS FET N2 and the first and second PMOS FET's P1 and P2 begin to conduct and the voltage level at the output reference terminal REF is stabilized at the reference voltage level.

The voltage difference Vdiff1 of the junction A of the commonly connected gates of the first and second PMOS FET's P1 and P2 and the voltage level of the output reference terminal REF is sufficient to cause the NMOS FET N70 to turn off at time $T_2$ to disable the start-up circuit. That is:

$$V_{diff1} = V_A - V_{REF}$$

$$V_{diff1} < (n+1)V_{THn} \mid N70 \Rightarrow \text{OFF}$$
$$V_{diff1} > (n+1)V_{THn} \mid N70 \Rightarrow \text{ON}$$

where:

$V_A$=voltage level at junction of commonly connected gates of the first and second PMOS FET's P1 and P2.

$V_{REF}$ =voltage level of output reference terminal.

n=the number of diode connected FET's in the serial string N71, . . . , N7n.

$V_{Thn}$ is the threshold voltage of the NMOS FET's.

Figure 8:
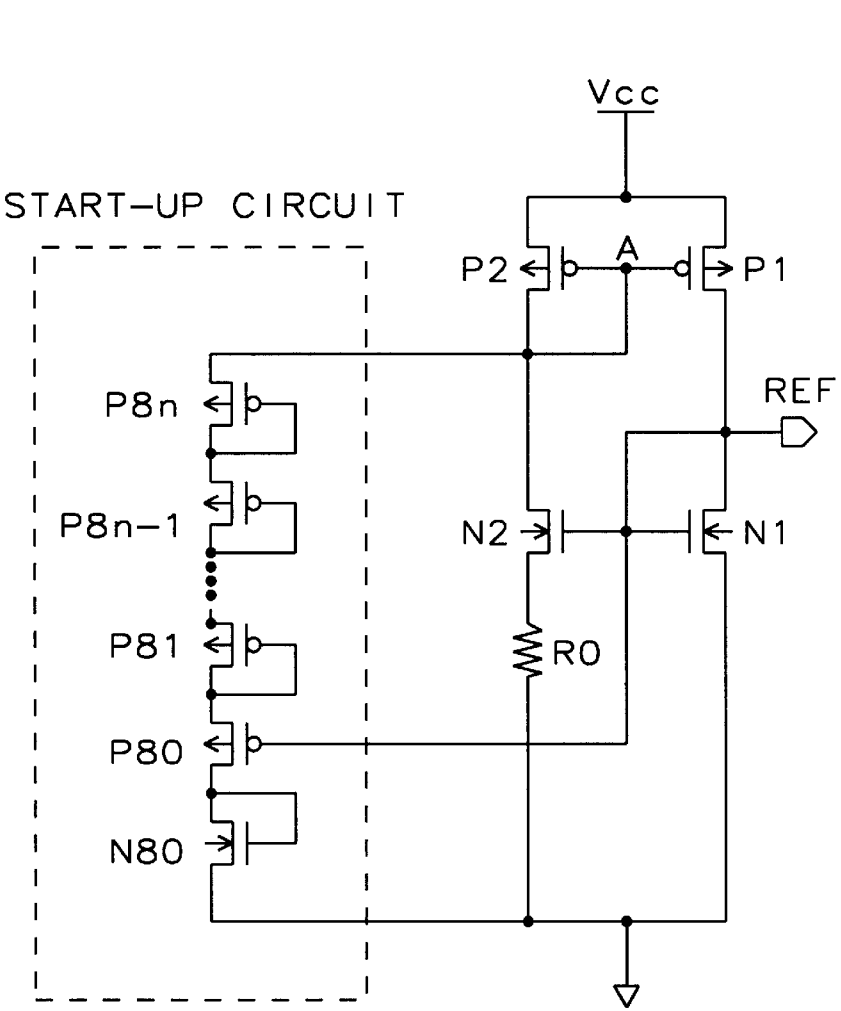
FIG. 8 is a schematic diagram of a second embodiment of the reference voltage generation circuit with the start-up circuit of this invention.

Refer now to FIG. 8 for a discussion of the structure and operation of the second embodiment of the reference voltage generation circuit of this invention. The PMOS FET's P1 and P2, the NMOS FET's N1 and N2, and the resistor RO form the reference voltage generation circuit as shown in FIG. 1. The start-up circuit of the second embodiment of this invention is composed of the serial string of diode connected PMOS FET's P81,. . . , P8n. The source of the diode connected PMOS FET P8n is connected to the junction A of the commonly connected gates of the first and second PMOS FET's P1 and P2 (A). The commonly connected gate and drain of the diode connected PMOS FET P81 is connected to the source of the PMOS FET P80. The drain of the PMOS FET P80 is connected to the commonly connected gate and drain of the NMOS FET N80. The source of the NMOS FET N80 is connected to the ground reference terminal of the power supply voltage source. The gate of the PMOS FET P80 is connected to the commonly connected gates of the NMOS FET's N1 and N2 (output reference terminal REF).

When the power supply voltage source is in a power-down mode all transistors of the circuit have no current flowing in them. When the power supply voltage source is initiated it will begin to rise from zero volts. Likewise, the voltage level of the commonly connected gates of the first and second PMOS FET's P1 and P2 (A) begins to follow the voltage level of the power supply voltage source. At this time the voltage level of the output reference terminal REF remains at zero volts. When the voltage difference between the junction A of the commonly connected gates and the voltage level of the output reference terminal REF exceed the voltage level of the sum of the threshold voltage $V_{TH}$ of the serial string of diode connected PMOS FET's P81, . . . , P8n and the PMOS FET P80, the PMOS FET P80 turns on and a current flows through the serial string of diode connected PMOS FET's P81, . . . , P8n and the second PMOS FET P2. This current flow causes the second PMOS FET P2 to turn on to conduct and the first PMOS FET P1 and the first and second NMOS FET's N1 and N2 conduct to force the reference voltage generation circuit to the normal operational state as described above.

In the normal operational state, the difference of the voltage level at the junction A of the commonly connected gates of the first and second PMOS FET's P1 and P2 and the voltage level of the output reference terminal REF decreases to less than the sum of the threshold voltages of PMOS FET P80 and the serial string of diode connected PMOS FET's P81, .., P8n, the PMOS FET P80 turns off to deactivate the start-up circuit.

The diode connected NMOS FET N80 acts to reduce the effects of noise present on the ground reference terminal of the power supply voltage source during initialization.

In normal operation, the difference of the voltage level at the junction A of the commonly connected gates of the first and second PMOS FETs P1 and P2 and the voltage level of the output reference terminal REF is known and the numbers of diode connected NMOS FET's can be appropriately determined.

Figure 10:
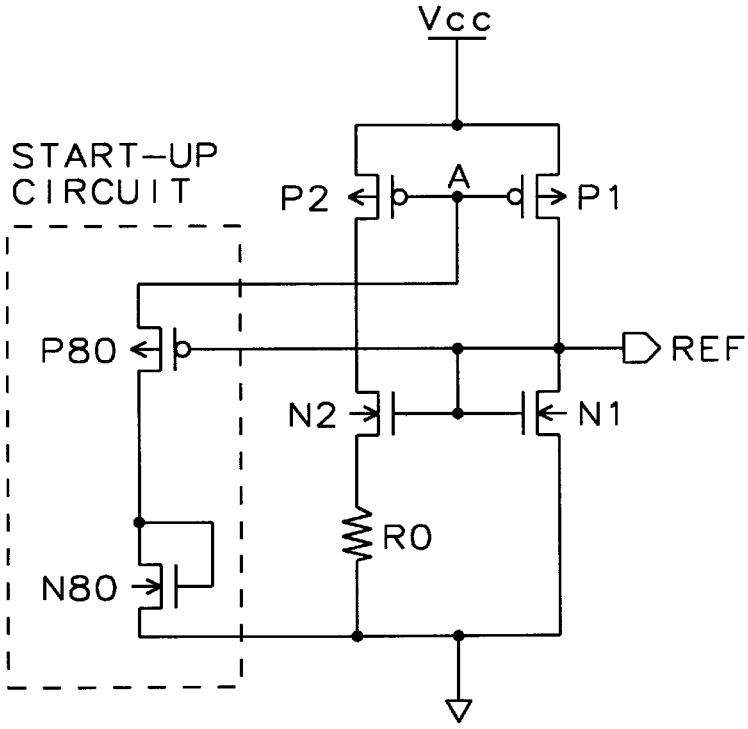
FIG. 10 is a schematic diagram of a simplified implementation of the reference voltage generation circuit of this invention.

If the difference in the voltage level at the junction A of the of the commonly connected gates of the first and second PMOS FET's and the voltage level of the output reference terminal REF is less than one threshold voltage $V_{TH}$, the start-up circuit can be simplified as shown in FIG. 10. In FIG. 10 the serial string of diode connected PMOS FET's P81, . . . , P8n are eliminated and the start-up circuit is comprised of the PMOS FET P80 and the diode connected NMOS FET N80.

Figure 12:
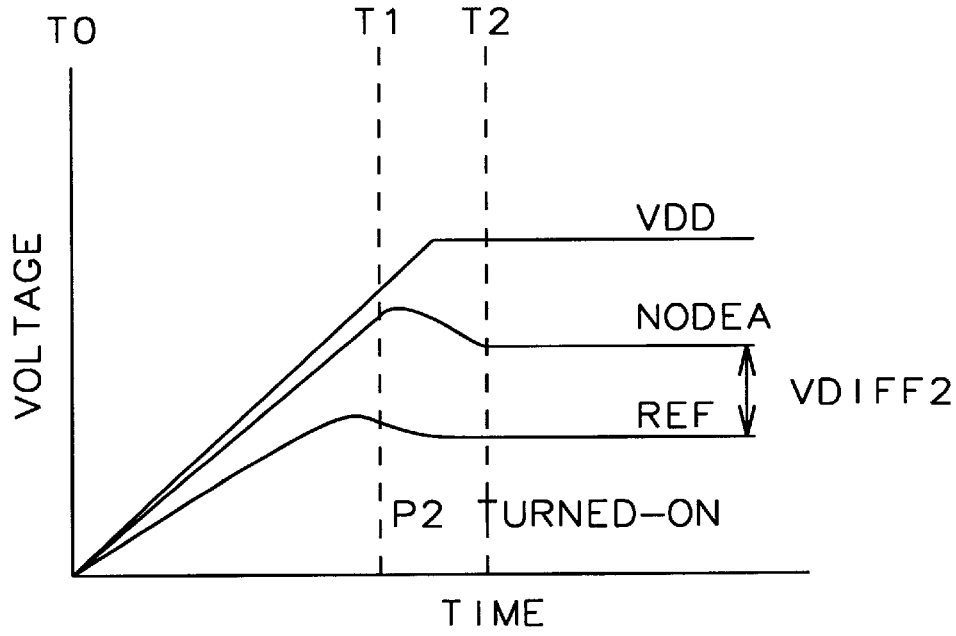

FIG. 12 shows a plot of voltage versus time of the reference voltage generation circuit of FIG. 8. At time To the power supply voltage source is turned on and begins to rise towards its final value. As described above, the voltage level at the junction A of the commonly connected gates of the first and second PMOS FET's P1 and P2 follow the rise of the voltage level of the power supply voltage source. At the time $T_1$, the voltage level at the junction A of the commonly connected gates of the first and second PMOS FET's P1 and P2 exceeds the voltage level sufficient to turn on the PMOS FET P80 causing the second PMOS FET P2 to turn on. The first PMOS FET P1 and the first and second NMOS FET's N1 and N2 begin to conduct and the voltage level at the output reference terminal REF is stabilized at the reference voltage level.

The voltage difference Vdiff2 of the junction A of the commonly connected gates of the first and second PMOS FET's P1 and P2 and the voltage level of the output reference terminal REF is sufficient to cause the PMOS FET P80 to turn off at time $T_2$ to disable the start-up circuit. That is:

$$V_{diff2} = V_{REF} - V_A$$

$$V_{diff2} < (n+1)V_{THp} \mid P80 \Rightarrow \text{ON}$$
$$V_{diff2} > (n+1)V_{THp} \mid P80 \Rightarrow \text{OFF}$$

where:

$V_A$=voltage level at junction of commonly connected gates of the first and second PMOS FET's P1 and P2.

$V_{REF}$=voltage level of output reference terminal.

n the number of diode connected FET's in the serial string P81, . . . , P8n.

$V_{TH}$ is the threshold voltage of the PMOS FET's.

In summary, the start-up circuit of this invention rapidly activates the normal operation of a reference voltage generation circuit into which it is included. Further, the start-up circuit of this invention includes a diode connected MOS transistor to reduce the effects of noise present on the power supply voltage source during the initialization or power-up time. Finally, the power-up circuit of this invention senses the voltage level present at the output reference terminal REF and disables the start-up circuit when the voltage level of the output reference terminal REF reaches the reference voltage level. The disabled start-up circuit will have no static current present and will consequently dissipate no power.

While this invention has been particularly shown and described with reference to the preferred embodiments thereof, it will be understood by those skilled in the art that various changes in form and details may be made without departing from the spirit and scope of the invention.

The invention claimed is:

1. A reference voltage generation circuit comprising:

a reference voltage generator connected to a power supply voltage source for producing a reference voltage at an output reference terminal that is independent of the power supply voltage source; and a start-up circuit connected to the output reference terminal for providing an initiation voltage to said reference voltage generator to force the output reference terminal to assume the reference voltage at the application of the power supply voltage source while reducing noise variations being coupled from said power supply voltage source to said reference voltage generator and, comprising a sensing circuit connected to a voltage sense point within said the reference voltage generator to disable said start-up circuit when the reference voltage is present at the output reference terminal, a plurality of serially joined diode connected MOSFET's of a first conductivity type connected between the sensing circuit and the output reference terminal to provide the initiation voltage; and a diode connected MOSFET of a second conductivity type connected between the sensing circuit and the power supply voltage source to reduce noise variations.

2. The reference voltage generation circuit of claim 1 wherein the sensing circuit further comprises:

a sensing MOSFET of the first conductivity type having a source connected to the plurality of serially joined diode connected MOSFET's, a drain connected to the diode connected MOSFET of the second conductivity type, and a gate connected to the reference voltage generator such that the sensing MOSFET turns off when the voltage present at the output reference terminal is the level of the reference voltage.

3. A start-up circuit for use with a supply independent reference voltage generator and connected to a voltage sense point within the reference voltage generator and the output reference terminal for providing an initiation voltage to said reference voltage generator to force the output reference terminal to assume the reference voltage at the application of the power supply voltage source while reducing noise variations being coupled from said power supply voltage source to said reference voltage generator, and comprising:

a plurality of serially ioined diode connected MOSFET's of a first conductivity type connected between the sensing circuit and the output reference terminal to provide the initiation voltage;

a diode connected MOSFET of a second conductivity type connected between the sensing circuit and the power supply voltage source to reduce noise variations; and a sensing circuit connected to the voltage sense point of the reference voltage generator to disable said start-up circuit when the reference voltage is present at the output reference terminal.

4. The start-up circuit of claim 3 wherein the sensing circuit is comprising:

a sensing MOSFET of the first conductivity type having a source connected to the plurality of serially joined diode connected MOSFET's, a drain connected to the diode connected MOSFET of the second conductivity type, and a gate connected to the reference voltage generator such that the sensing MOSFET turns off when the voltage present at the output reference terminal is the level of the reference voltage.

5. A self-starting bias voltage generation circuit connected between two terminals of a power supply voltage source comprising:

a bias reference voltage generator comprising:

a first and second MOS transistor of a first conductivity type each having gates commonly connected to a drain of the first MOS transistor and sources connected to the first terminal of the power supply voltage source, a first and second MOS transistor of a second conductivity type each having gates commonly connected to the drains of both of the second MOS transistors of the first and second conductivity type thus forming an output bias reference terminal containing a bias reference voltage, whereby a drain of the first MOS transistor is connected to the commonly connected gates of the first and second MOS transistor of the first conductivity type, and a source of the second MOS transistor of the second conductivity type is connected to the second terminal of the power supply voltage source, and a resistor between the second terminal of the power supply voltage source and the source of the first MOS transistor of the second conductivity type;

a start-up circuit connected to the commonly connected gates of the first and second MOS transistors of the first conductivity type and to the commonly connected gates of the first and second MOS transistors of the second conductivity type to force the output bias reference voltage terminal to assume the bias reference voltage upon initiation of the power supply voltage source, while reducing noise variations being coupled from said power supply voltage source to said bias reference voltage generator, whereby said start-up circuit comprises:

a plurality of serially joined diode connected MOS transistors of a first conductivity tvpe connected between the sensing circuit and the output reference terminal to provide the initiation voltage; and a diode connected MOS transistor of a second conductivity type connected between the sensing circuit and the power supply voltage source to reduce noise variations; and a sensing circuit connected between the start-up circuit and the bias reference voltage generator to disable said start-up circuit when the bias reference voltage is present at the output bias reference terminal, whereby said sensing circuit comprises:

a sensing MOS transistor of the first conductivity type having a source connected to the plurality of serially joined diode connected MOS transistors, a drain connected to the diode connected MOS transistor of the second conductivity type, and a gate connected to the reference voltage generator such that the sensing MOSFET turns off when the voltage present at the output reference terminal is the level of the reference voltage.

* * * * *